US010612849B2

(12) United States Patent
Gammack et al.

(10) Patent No.: US 10,612,849 B2
(45) Date of Patent: Apr. 7, 2020

(54) HAND DRYER

(71) Applicant: Dyson Technology Limited, Wiltshire (GB)

(72) Inventors: Peter David Gammack, Malmesbury (GB); Stephen Benjamin Courtney, Malmesbury (GB); Leigh Michael Ryan, Malmesbury (GB); Stuart James Steele, Malmesbury (GB)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 1679 days.

(21) Appl. No.: 13/850,889

(22) Filed: Mar. 26, 2013

(65) Prior Publication Data

US 2013/0276328 A1 Oct. 24, 2013

(30) Foreign Application Priority Data

Mar. 26, 2012 (GB) ..... 1205260.1

(51) Int. Cl.
*F26B 21/00* (2006.01)
*A47K 10/48* (2006.01)

(52) U.S. Cl.
CPC ..... *F26B 21/004* (2013.01); *A47K 10/48* (2013.01)

(58) Field of Classification Search
CPC ..... A47K 10/48; F26B 21/004; F26B 25/06
USPC ..... 34/523
See application file for complete search history.

(56) References Cited

U.S. PATENT DOCUMENTS 1,997,387 A 4/1935 McCord
5,146,695 A 9/1992 Yang
6,038,786 A 3/2000 Aisenberg et al.
7,437,833 B2 10/2008 Sato et al.
D599,059 S 8/2009 Clerch
7,596,883 B2 10/2009 Kameishi
(Continued)

FOREIGN PATENT DOCUMENTS

CN 102665512 9/2012
DE 30 36 623 2/1982
(Continued)

OTHER PUBLICATIONS

Bobrick Technical Data, TrimLine Surface-Mounted ADA Dryer, B-7120, B-7128, Apr. 27, 2011.*
(Continued)

*Primary Examiner* — Edelmira Bosques
*Assistant Examiner* — Bao D Nguyen
(74) *Attorney, Agent, or Firm* — Morrison & Foerster LLP

(57) ABSTRACT

The invention relates to a wall-mountable hand dryer of the type which uses an air-knife to wipe the water from a user's hand. In accordance with the invention, the hand dryer is configured to have a maximum depth, front-to-back, of less than 150 mm when it is surface-mounted on—rather than recessed within—the wall. The dryer has a projecting part which projects outwardly either from the wall or from a rear part of the dryer, and the air-knife is directed downwardly onto the user's hand as it is passed lengthwise underneath the projecting part of the dryer. The air knife is discharged through one or more discharge apertures, and these discharge apertures are positioned towards the front of the projecting part so that they are spaced at least 75 mm from the wall or, as the case may be, the rear part of the dryer.

13 Claims, 11 Drawing Sheets

(56) References Cited

U.S. PATENT DOCUMENTS

| | | | | |
|---|---|---|---|---|
| 7,614,160 | B2 | 11/2009 | Kameishi et al. | |
| 7,971,368 | B2 | 7/2011 | Fukaya et al. | |
| 8,043,714 | B2 | 10/2011 | Hashimoto | |
| 8,136,262 | B2 | 3/2012 | Collins | |
| 8,347,522 | B2 | 1/2013 | Dyson et al. | |
| 8,607,472 | B2 | 12/2013 | Ishii et al. | |
| 2008/0263889 | A1 | 10/2008 | Fukaya et al. | |
| 2008/0313918 | A1* | 12/2008 | Dyson | A47K 10/48 34/202 |
| 2009/0000140 | A1 | 1/2009 | Collins | |
| 2009/0044420 | A1* | 2/2009 | Hsu | A47K 10/48 34/88 |
| 2010/0192399 | A1 | 8/2010 | Sawabe et al. | |
| 2011/0277342 | A1 | 11/2011 | Ishii et al. | |
| 2012/0017460 | A1 | 1/2012 | Kikuchi et al. | |
| 2013/0042495 | A1 | 2/2013 | Ryan et al. | |
| 2013/0042496 | A1 | 2/2013 | Courtney et al. | |
| 2013/0042497 | A1 | 2/2013 | Ryan et al. | |
| 2013/0055588 | A1 | 3/2013 | Nakamura et al. | |
| 2013/0269208 | A1 | 10/2013 | Gammack et al. | |

FOREIGN PATENT DOCUMENTS

| | | |
|---|---|---|
| GB | 737054 | 9/1955 |
| GB | 909069 | 10/1962 |
| GB | 915674 | 1/1963 |
| GB | 2 428 569 | 2/2007 |
| GB | 2 428 570 | 2/2007 |
| GB | 2 450 561 | 12/2008 |
| GB | 2 450 563 | 12/2008 |
| JP | 61-179993 | 11/1986 |
| JP | 4-221523 | 8/1992 |
| JP | 9-56640 | 3/1997 |
| JP | 9-135788 | 5/1997 |
| JP | 10-113305 | 5/1998 |
| JP | 10-257992 | 9/1998 |
| JP | 11-283 | 1/1999 |
| JP | 2000-180 | 1/2000 |
| JP | 2000-157448 | 6/2000 |
| JP | 2000-184987 | 7/2000 |
| JP | 2002-136448 | 5/2002 |
| JP | 2004-215879 | 8/2004 |
| JP | 2007-98106 | 4/2007 |
| JP | 2007-143584 | 6/2007 |
| JP | 2008-5883 | 1/2008 |
| JP | 2008-272251 | 11/2008 |
| JP | 2009-502392 | 1/2009 |
| JP | 2013-22226 | 2/2013 |
| JP | 2013-39377 | 2/2013 |
| WO | WO-2009/011198 | 1/2009 |
| WO | WO-2010/088975 | 8/2010 |
| WO | WO-2010/095250 | 8/2010 |
| WO | WO-2010/095251 | 8/2010 |
| WO | WO-2011/077625 | 6/2011 |
| WO | WO-2013/024252 | 2/2013 |

OTHER PUBLICATIONS

Search Report dated Jul. 19, 2012, directed towards GB Application No. 1205260.1; 2 pages.

Mediclinics Catalogue 2009-2010, "Speedflow (RTM) Hand dryers," on pp. 14-15 and Technical specifications on p. 15 located at <http://www.mediclinics.co.uk/downloads/mediclinicscatalogue20092010.pdf> accessed on Jul. 16, 2012. (69 pages).

World Dryer: Press Release (May 31, 2011) "SLIMdri: The Bantamweight that Packs a Punch," Berkeley, IL, located at <http://www.worlddryer.com/node/267> accessed on Jul. 16, 2012. (1 page).

World Dryer: SLIMdri Hand Dryer. Surface-Mounted ADA Compliant Hand Dryer brochure located at <http://www.worlddryer.com/sites/default/files/92_MT050_SLIMdri_sellsheet.pdf> accessed Jul. 16, 2012. (2 pages).

Bobrick: TrimLine Surface-Mounted ADA Dryer B-7120, B-7128 Technical data Sheet located at <http://www.bobrick.co.uk/media/uploads/products/B-7120,_71281.pdf> accessed Jul. 16, 2012. (4 pages).

Ryan et al., U.S. Office Action dated Jun. 16, 2014, directed to U.S. Appl. No. 13/587,422; 8 pages.

Courtney et al., U.S. Office Action dated Sep. 11, 2014, directed to U.S. Appl. No. 13/587,453; 6 pages.

International Search Report and Written Opinion dated Dec. 2, 2013, directed toward International Application No. PCT/GB2013/050557; 10 pages.

Gammack et al., U.S. Office Action dated Oct. 29, 2015, directed to U.S. Appl. No. 13/850,923; 16 pages.

* cited by examiner

HAND DRYER

REFERENCE TO RELATED APPLICATIONS

This application claims priority of United Kingdom Application No. 1205260.1 filed Mar. 26, 2012, the entire contents of which are incorporated herein by reference.

FIELD OF THE INVENTION

The present invention relates to a wall-mountable hand dryer of the type which uses an air-knife to wipe water from the surface of the user's hands.

BACKGROUND OF THE INVENTION

Hand dryers are typically installed in public washrooms as an alternative to paper towels.

There are three main types of hand dryer on the market: "warm-air" hand dryers, "high speed" hand dryers and "air-knife" hand dryers.

Warm air hand dryers are very well known. They are invariably low flow, low speed machines which rely on heating the air to promote an evaporative drying effect at the surface of the hand. Examples include the Model A Series of hand dryers manufactured and marketed by World Dryer Corporation. The heated airflow is typically discharged through a single nozzle and the drying action is a "hand-over-hand" action, requiring the user to rub the hands together under the nozzle with the aim of encouraging the evaporative drying effect.

High speed hand dryers, as the name suggests, use high speed airflow (>80 m/s) to provide a momentum-drying effect at the surface of the hands. Examples include the Xlerator® hand dryer manufactured and marketed by Excel Dryer Inc. Again the airflow is typically discharged through a single relatively large nozzle and the mode of use is somewhat similar to the "hand-over-hand" action of the warm air dryer, with the hands being held or cupped together underneath the nozzle to dry them. However, instead of being evaporated, the vast majority of the water on the surface of the hands is instead driven or blasted from the hands by the high-momentum airflow, with evaporation accounting for only a small proportion of water removal. The airflow tends not to be heated, though waste heat from the motor may in some cases be used to heat the airflow to a degree.

The third general type of hand dryer is the air-knife hand dryer, examples of which include the Dyson Airblade range of Hand Dryers manufactured by Dyson (UK) Limited and the Jet Towel hand dryer manufactured by Mitsubishi Electric Corporation These hand dryers use an air-knife—effectively a sheet or curtain of moving air—to remove the water from the user's hands. The mode of operation is analogous to the established use of air knives in industry to remove debris or liquid from the surface of a product (see e.g. EP2394123A1, which describes removal of debris from a glass sheet using air knives): the air-knife moves across the surface of the hand and, as it does so, wipes or scrapes the water from the surface of the hand.

In both the Dyson Airblade and the Mitsubishi Jet Towel, two opposing, stationary air-knives are used, one for each side of the user's hand. The hands are inserted between the air-knives and then withdrawn slowly to effect the required relative movement between the hands and the air knives.

In the Dyson arrangement—shown in FIG. 1—the air knives are discharged through narrow, continuous slots (only the rear slot a is visible in FIG. 1), each less than 1 mm wide. In the Mitsubishi machine—shown in FIG. 2—the air-knife is instead discharged through opposing rows of individual discharge apertures (only the rear row b is visible in FIG. 2): here, the individual jets combine to produce the air knife downstream of the discharge apertures. In each case, the air knife is discharged at high speed (>80 m/s) to provide for an efficient wiping action across the surface of the hand.

SUMMARY OF THE INVENTION

The present invention is concerned with air-knife hand dryers, specifically.

According to the present invention there is provided a wall-mountable hand dryer of the type which uses an air-knife to wipe the water from a user's hand, the hand dryer being configured to have a maximum depth, front-to-back, of less than 150 mm when it is surface-mounted on—rather than recessed within—the wall, the dryer having a projecting part which projects outwardly either from the wall or from a rear part of the dryer, the air-knife being directed downwardly onto the user's hand as it is passed lengthwise underneath the projecting part of the dryer, the air knife being discharged through one or more discharge apertures, the discharge apertures being positioned towards the front of the projecting part so that they are spaced at least 75 mm from the wall or, as the case may be, the rear part of the dryer.

The hand dryer has the advantage that it is a low profile design. The maximum depth of 150 mm when it is surface mounted on the wall is significantly less than the current range of Dyson Airblade hand dryers (depth front-to-back 250 mm approx) or the Mitsubishi Jet Towel hand dryer (depth front-to-back 220 mm approx). In particular, the maximum depth of the dryer may be 4 inches (101.6 mm) or less, allowing surface-mounting of the hand dryer in compliance with the Americans with Disabilities Act 1990 (ADA). This avoids the inconvenience and expense of having to recess the hand dryer into the wall in order to comply with the ADA: particularly advantageous when retro-fitting the hand dryer.

Despite the significant reduction in profile depth, the dryer nevertheless provides an effective air-knife drying action. The user dries the hands palm-open—moving the hands lengthwise front-to-back underneath the projecting part. The air knife is directed downwardly onto the hands and, as the hand is moved relative to the discharge slot, the air-knife mechanically wipes the water from the surface user's hands to dry them.

Because the drying action is a front-to-back action, the user can increase the effective depth of the dryer front-to-back by pitching the hands down. The most suitable pitch angle will vary according to the effective depth required by the user—users with larger hands will tend to pitch their hands at a steeper angle. By spacing the discharge apertures at least 75 mm from the wall, however, the pitch angle is maintained within comfortable limits for most users. Consequently, the invention provides a shallow, low profile hand dryer which nevertheless offers an effective air knife drying action.

The discharge apertures are preferably spaced the maximum depth from the wall. This maximises the effective depth of the dryer in use.

The discharge apertures may be provided on the underside of the projecting part, preferably along the front lower edge of the projecting part to maximize the spacing between the discharge apertures and the wall (or rear part of the dryer).

The projecting part itself may be an external casing of the dryer which projects from the wall in use, in which case the effective depth of the dryer can be maximised by arranging the discharge apertures along a front lower edge of the casing.

The discharge aperture(s) may be arranged in a V-configuration (viewed from the front of the dryer). This allows a user to bank his or her hands at a comfortable angle in use.

The discharge aperture(s) are preferably arranged to span the width of a user's hand, so that the air-knife provides a wiping action the full width of the user's hand. A lateral span of at least 80 mm is considered preferable, though not essential. If it is intended to dry both hands at the same time, then the discharge aperture(s) may be arranged to span the width of both hands side-by-side underneath the discharge apertures(s). A lateral span of at least 200 mm is considered preferable in this case, though again this is not essential—a shorter span may be suitable for certain countries, for example.

The discharge aperture(s) may be arranged to span the width of a user's hand, so that the air-knife provides a wiping action the full width of the user's hand. A lateral span of at least 80 mm is considered sufficient in most cases. If it is intended to dry both hands at the same time, then the discharge aperture(s) may be arranged to span the width of both hands side-by-side underneath the discharge apertures(s). A lateral span of at least 200 mm is considered preferable in this case, though again this is not essential—a shorter span may be suitable for certain countries, for example.

The exit airspeed through the discharge aperture(s) is preferably in excess of 80 m/s to ensure that the air knife has an effective wiping action at the surface of the hands. A particularly effective wiping action can be obtained at airspeeds in excess of 150 m/s. The exit air speed is determined in accordance with general air knife principles by the discharge area and the pressure behind the discharge aperture(s). So, for example, increasing the discharge area will reduce the exit air speed at a given pressure. Increasing the pressure for a given discharge area will increase the exit air speed.

The discharge aperture(s) may take the form of air holes arranged in a row or, alternatively, an elongate air slot. For example a single elongate air slot or row of air holes may be provided to discharge a single air-knife for drying the hands one after another; a pair of such slots or rows of holes may be provided for generating two separate air-knives which dry the hands simultaneously, or a single elongate slot or row of holes may be provided for generating a single air knife which is sufficiently long to dry the hands simultaneously side-by-side.

The slot, or air holes, may be less than 2 mm wide, intended to provide a laminar, well-defined air knife with minimal wind shear. In one embodiment, the length of the slot—or length of the row of air holes—is at least 80 mm.

In one embodiment, the discharge apertures are provided on the underside of an external casing of the hand dryer so that they face the floor, rather than a lower part of the hand dryer. This arrangement has the benefit of a large clearance underneath the discharge aperture for pitching the hands in use.

BRIEF DESCRIPTION OF THE DRAWINGS

Embodiments of the invention will now be described with reference to the accompanying drawings, in which.

DETAILED DESCRIPTION OF THE INVENTION

Figure 1:
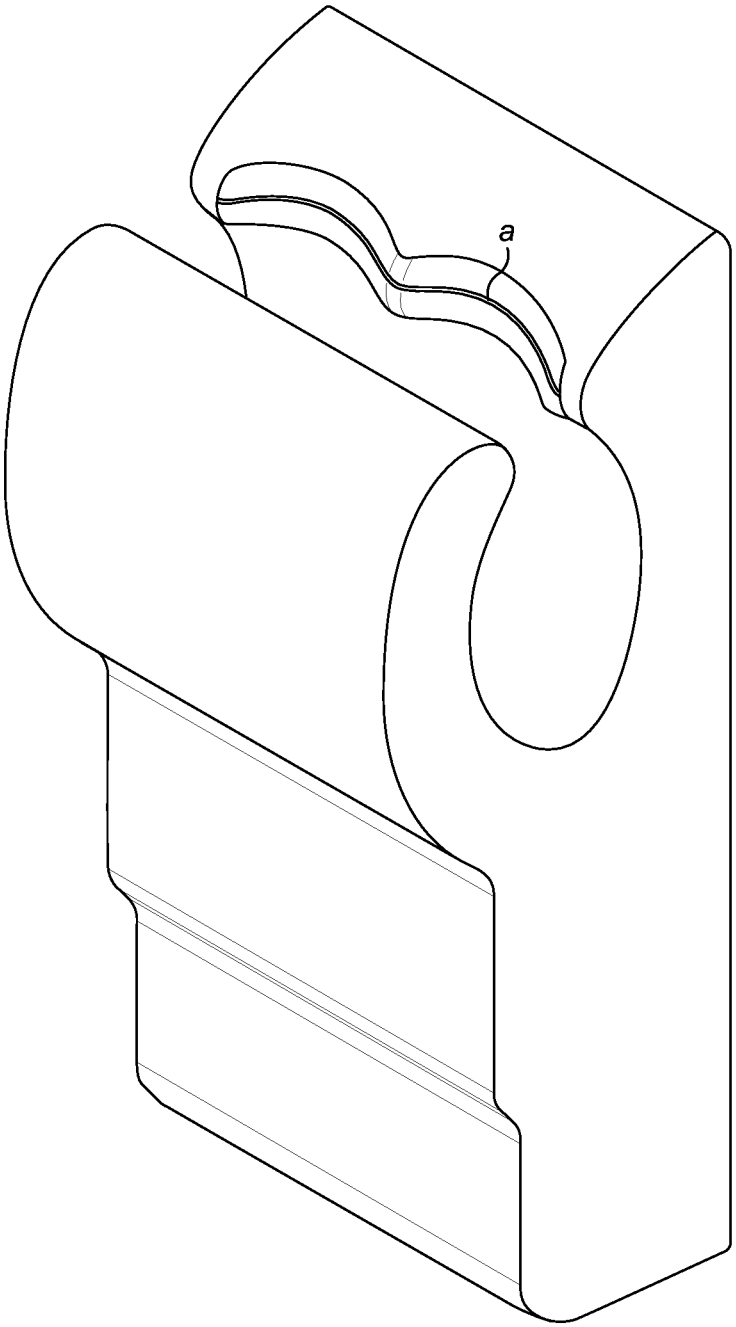
FIG. 1 Prior Art
FIGS. 1 and 2 are schematic perspective views of conventional air-knife hand dryers.

For simplicity, unless otherwise stated corresponding features have been given corresponding reference numerals in the following description.

Figure 3:
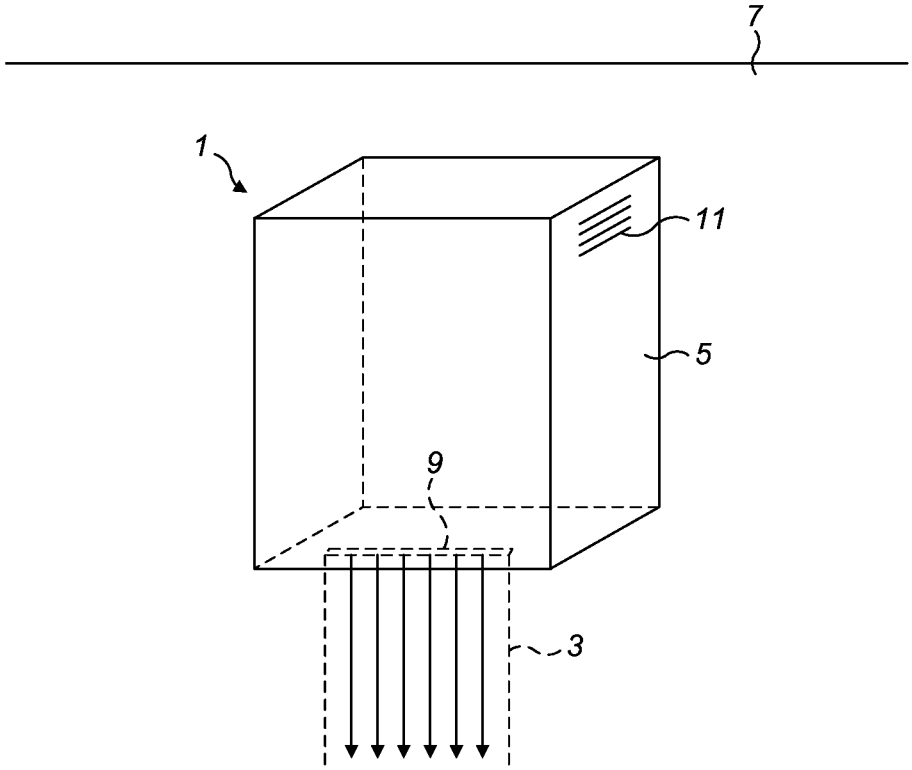
FIG. 3 is a schematic perspective view of a wall-mountable hand dryer in accordance with a first embodiment of the present invention.
Figure 4:
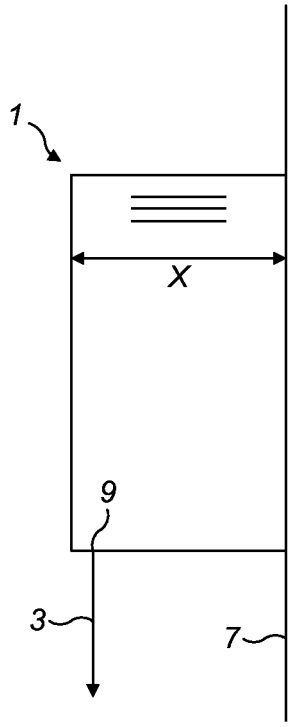
FIG. 4 is a side view of the hand-dryer in FIG. 3.

FIGS. 3 and 4 illustrate a wall-mountable hand dryer 1 which works by using an air knife 3—a curtain or sheet of moving air—to wipe the water from a user's hands.

The hand dryer 1 is illustrated in its normal wall-mounted orientation.

The hand dryer 1 comprises an external box-like casing 5 which projects a maximum depth X from the wall 7. In this case X=4 inches (101.6 mm) and thus the dryer is ADA-compliant, meaning that it complies with the Americans with Disabilities Act 1990:

"4.4.1* General. Objects projecting from walls (for example, telephones) with their leading edges between 27 in and 80 in (685 mm and 2030 mm) above the finished floor shall protrude no more than 4 in (100 mm) into walks, halls, corridors, passageways, or aisles. . . . "

Source: ADA Accesibility Guidelines for Buildings and Facilities (ADAAG)

The air-knife 3 is discharged downwardly through a discharge aperture 9 on the underside of the casing 5.

The discharge aperture 9 is in the form of an elongate discharge slot, which extends laterally across the dryer 1 (in this case generally parallel with the wall 7).

Figure 5:
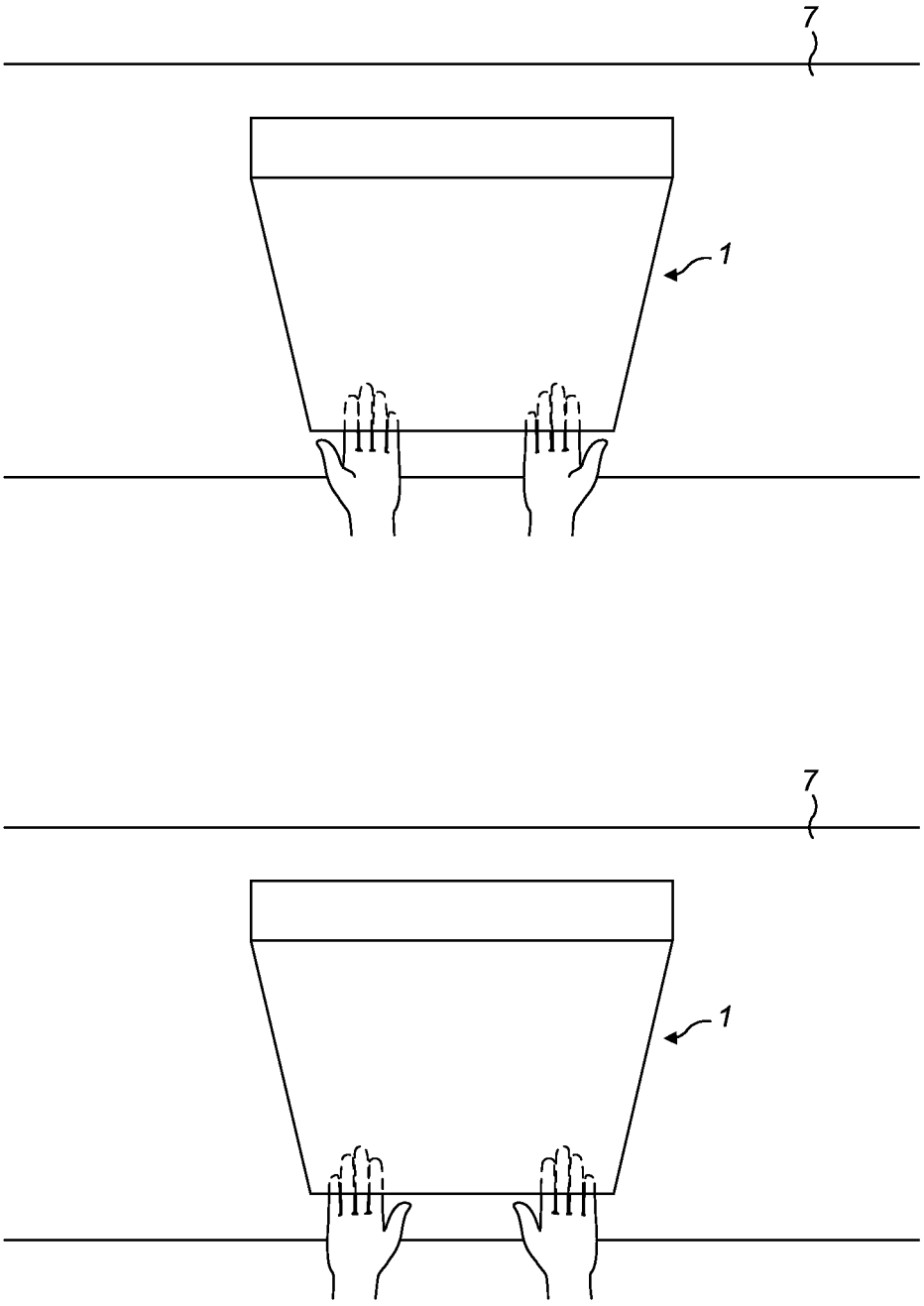
FIG. 5 are schematic views looking down on the hand dryer shown in FIG. 3, illustrating the mode of use of the hand dryer.

The user dries the hands palm-open, one side at a time, moving the hand lengthwise front-to-back underneath the discharge slot 9. This is illustrated in FIG. 5, looking down on the dryer from above.

The discharge slot 9 is 250 mm long—intended to span both hands held side-by-side under the discharge slot. A shorter discharge slot may alternatively be used—say, 120 mm in length—to dry first one hand and then the other in turn.

As the hands are moved relative to the discharge slot 9, the air-knife 3 mechanically wipes the water from the surface user's hands to dry them.

Figure 6:
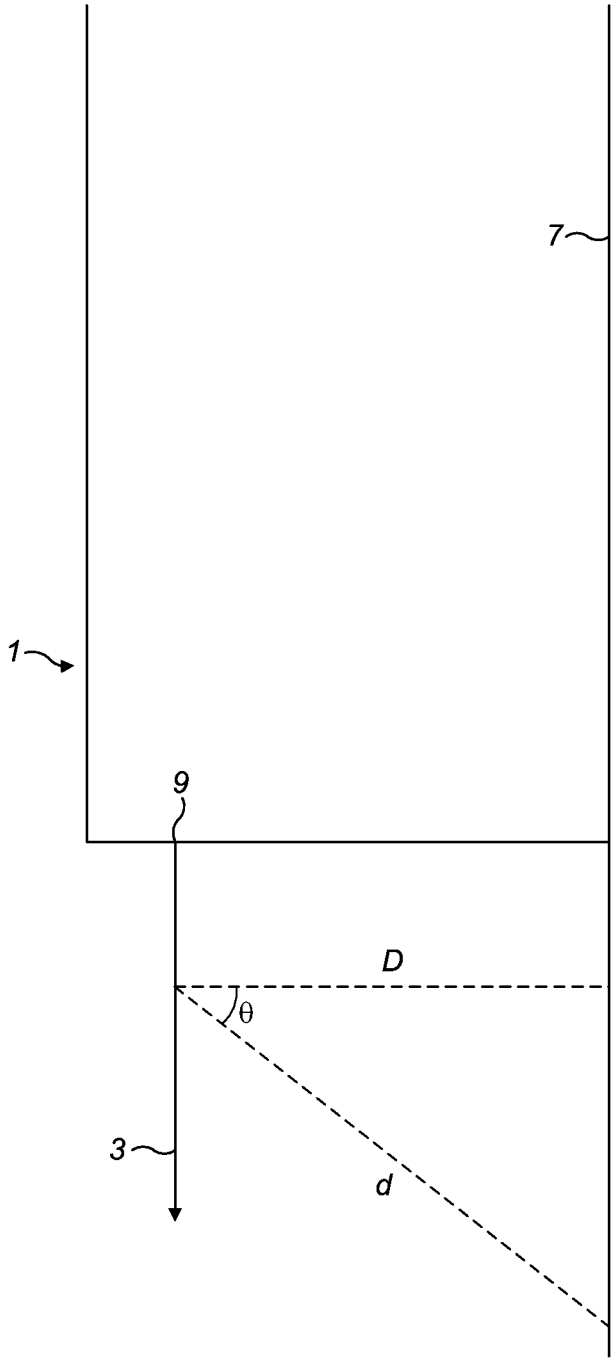
FIG. 6 is a side view of the bottom part of the hand dryer of FIG. 3.

The shallow depth of the dryer 1 on the wall 7 means that a typical user's fingertips will tend to contact the wall 7 if the hands are held horizontal underneath the dryer 1. However, the front-to-back drying action means that the user can avoid this by pitching the hand down at an angle θ as it passes underneath the discharge slot 9, increasing the effective depth of the dryer (FIG. 6).

If the discharge nozzles are spaced a distance, D, from the wall then the effective depth, d, is given by $D=d \cos \theta$. To provide for a comfortable pitch angle θ in most cases, D is set at 75 mm in accordance with the invention, so that the discharge slot 9 is spaced 75 mm from the wall 5 in use.

The precise pitch angle θ will vary from user to user for a given value of D. A user with relatively large hands, may prefer an effective depth d of, say, 150 mm—equating to a pitch angle θ of 60 degrees—whereas a user with small hands may only require an effective depth d of 120 mm—equating to a pitch angle θ of approximately 50 degrees.

If the maximum depth of the dryer exceeds 75 mm, then shallower pitch angles θ can be achieved by arranging the discharge apertures further towards the front of the dryer.

The discharge slot 9 is fed via a ducted motor-driven fan housed inside the external casing 5 of the dryer 1, which fan draws air in through the intakes 11 on the side of the casing 5 and forces this air out through the discharge slot 9 to generate the air-knife 3.

The discharge slot 9 is less than 2 mm in width. The motor-driven fan is configured to provide an exit airspeed through the discharge slot 9 in excess of 80 m/s. This is intended to provide a well-defined, high speed, laminar air-knife which exhibits low wind shear. A particularly effective wiping action can be obtained at airspeeds in excess of 150 m/s.

Alternatively, a source of compressed air may be used to feed the discharge slot 9 via a plenum chamber behind the slot 9.

The discharge slot 9 is formed directly in the wall of the casing 5. This provides for easy-cleaning of the casing 5, and allows the casing 9 itself to be used as a duct or plenum for feeding the discharge slot 9.

Preferably, the slot 9 is machined into the wall of the casing 5—this provides good dimensional tolerance—but if the casing 5 is moulded then the slot 9 itself could be moulded as part of the casing 5.

Figure 7:
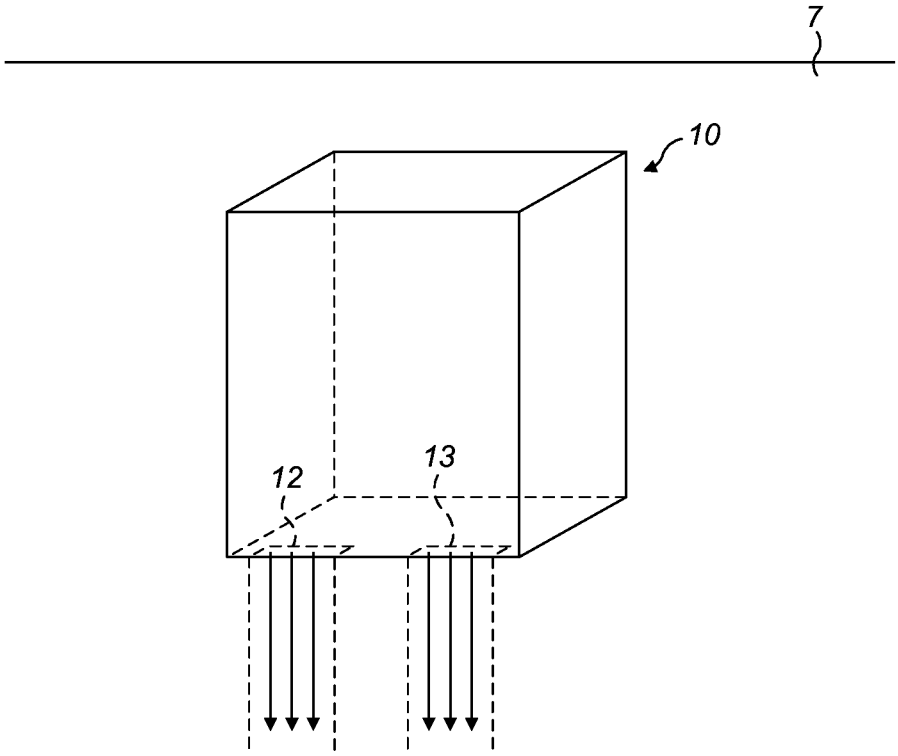
FIG. 7 is a schematic perspective view of a wall-mountable hand dryer in accordance with a second embodiment of the present invention.
Figure 8:
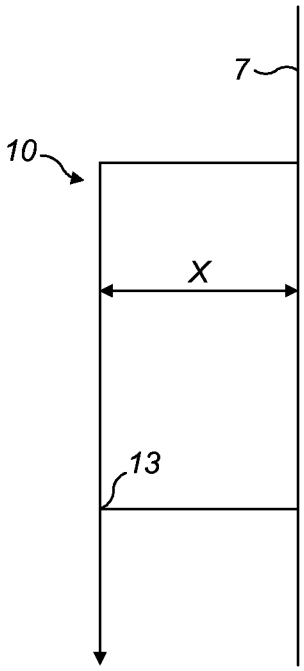
FIG. 8 is a side view corresponding to FIG. 7.

FIG. 7 shows an arrangement in which the dryer 10 is provided with two separate discharge slots 12, 13—one for each hand—rather than a single "double-span" discharge slot. Here, the slots are provided along a front lower edge of the casing (see FIG. 8), so that they are spaced the maximum depth X from the wall, which in this case is 4 inches (101.6 mm) for ADA compliance.

In this arrangement, an effective depth of 150 mm equates to a pitch angle θ of 48 degrees and an effective depth of 120 mm equates to a pitch angle θ of 34 degrees.

Figure 9:
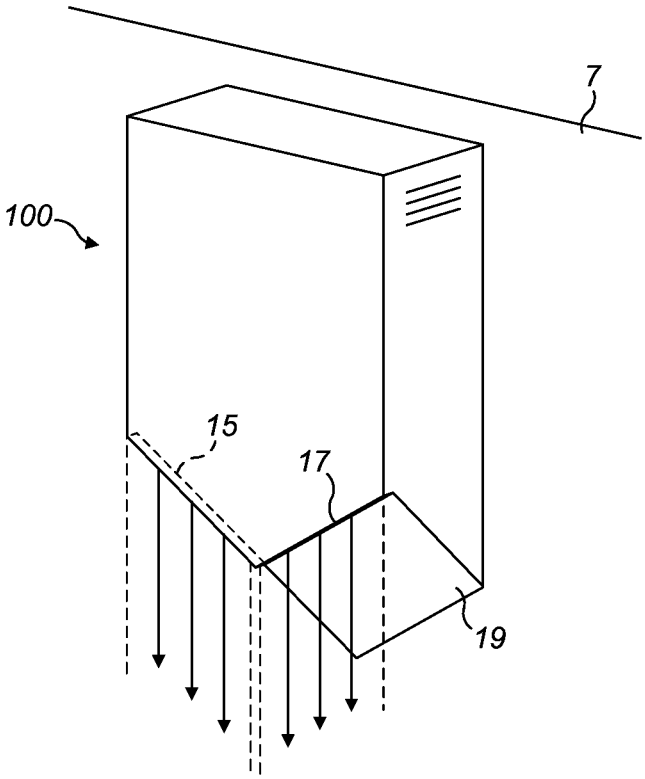
FIG. 9 is a schematic perspective view of a wall-mountable hand dryer in accordance with a third embodiment of the present invention.
Figure 10:
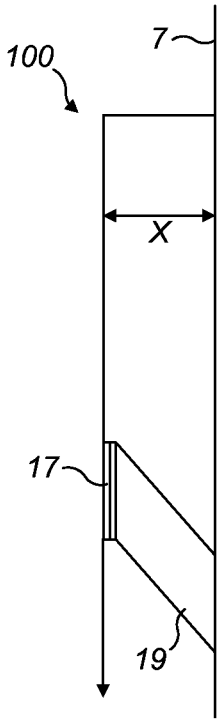
FIG. 10 is a side view corresponding to FIG. 9.

FIGS. 9 and 10 show an arrangement in which the dryer 100 is provided with discharge slots 15, 17 which are arranged in a V-configuration (viewed from the front of the dryer 100). This allows a user to bank the hands in use, making the drying action more comfortable for the user. The discharge slots 15, 17 are provided along a front, lower edge of the dryer 100, which edge is V-shaped to provide the required V-shaped configuration of the slots 15, 17.

A guide ramp 19 is additionally provided behind the slots 15, 17 in this arrangement. This is not essential, but it provides the benefit that it encourages a user to pitch the hands down in use.

Figure 11:
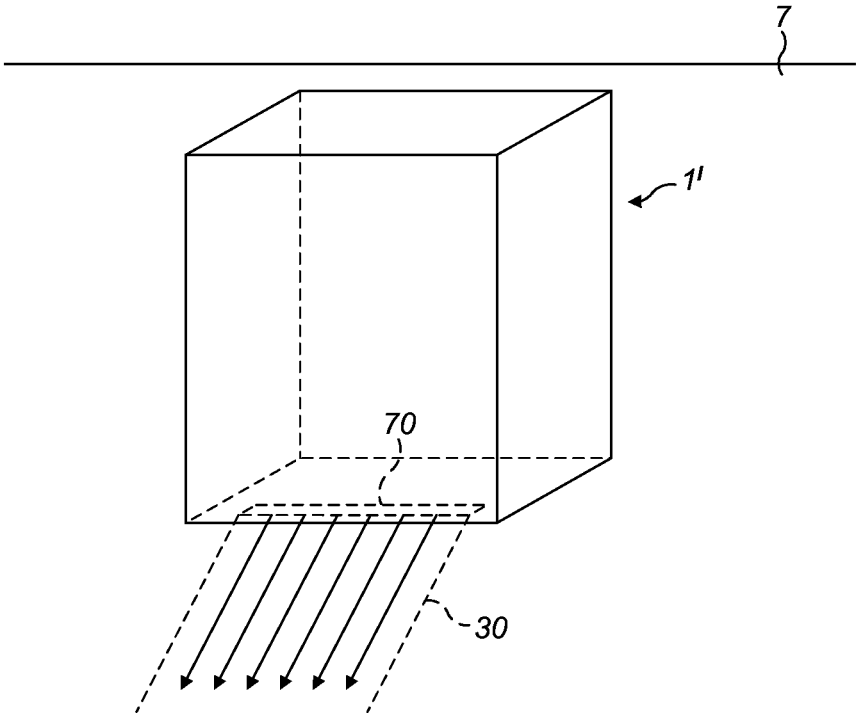
FIG. 11 is a schematic perspective view of a wall-mountable hand dryer in accordance with a fourth embodiment of the present invention.

The air-knife need not be directed vertically downwardly: it may project outwardly at an angle, for example. This is shown in FIG. 11. Here, a single discharge slot 70 is configured to discharge an air-knife 30 forwardly towards the user, at a downward angle. The dryer 1' is similar in other respects to the dryer 1.

Figure 12:
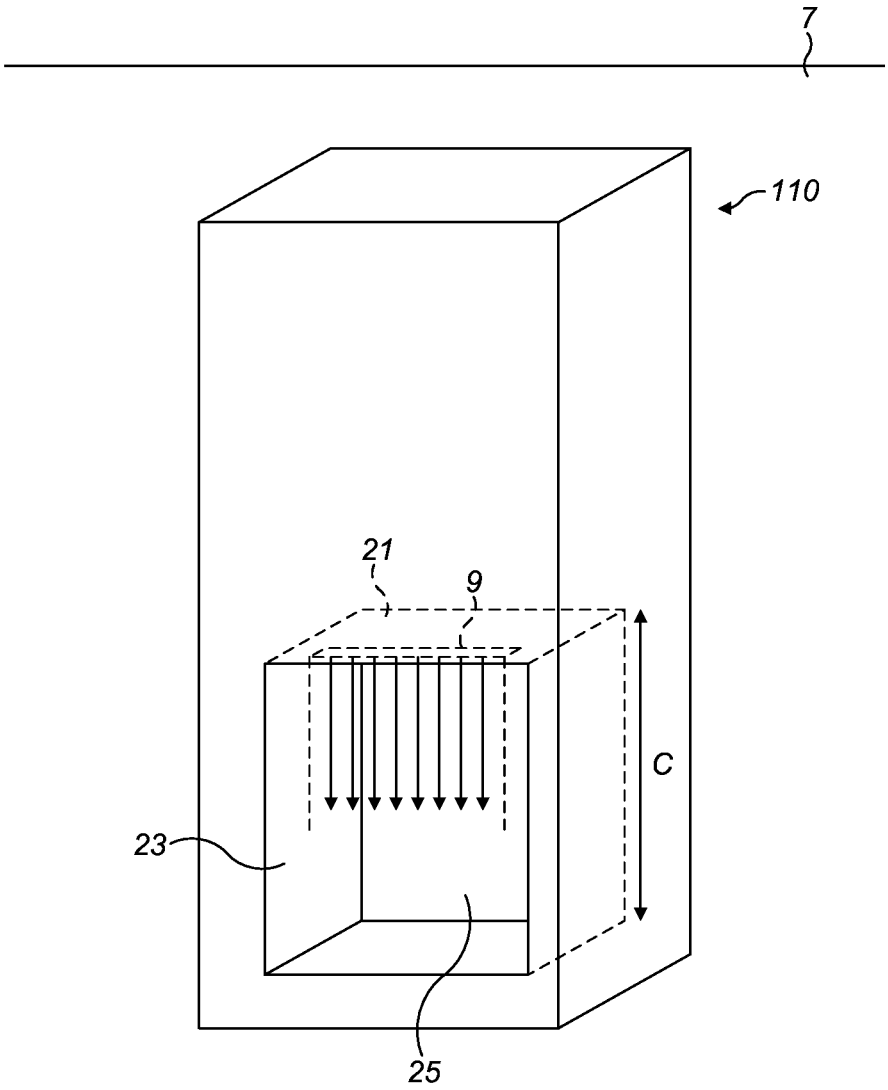
FIG. 12 is a schematic perspective view of a wall-mountable hand dryer in accordance with a fifth embodiment of the present invention.

In the previous arrangements, the discharge apertures have been provided on the underside of an external casing of the dryer which projects from the wall. FIG. 12 shows an arrangement in which the discharge aperture—again in the form of a single discharge slot 9—is provided on a projecting part 21 forming the roof of a drying cavity 23 for collecting the waste water. The projecting part 21 in this case projects out from the rear wall 25 of the drying cavity 23, which rear wall 25 forms a rear part of the dryer 110.

The discharge slot 9 is spaced 75 mm from the rear wall 25 of the cavity 23.

In general, if the discharge aperture faces a lower part of the dryer—for example the base 27 drying cavity 23 in dryer 110—then the discharge aperture is preferably spaced a distance C from the lower part of the dryer to provide sufficient clearance under the discharge slot to allow the majority of users to pitch the hand down without touching the lower part of the dryer. In the arrangement in FIG. 12, this distance C is set at 120 mm, so that the discharge slot 9 is spaced 120 mm from the base 27 of the drying cavity 23.

Figure 13:
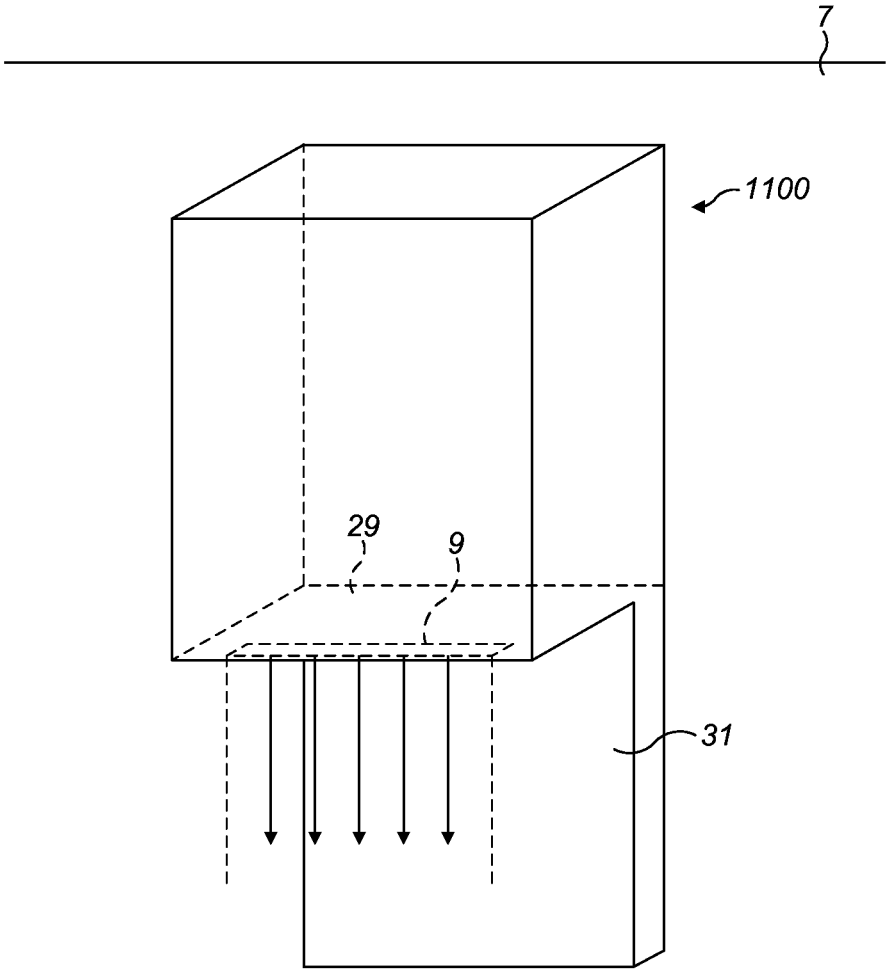
FIG. 13 is a schematic perspective view of a wall-mountable hand dryer in accordance with a sixth embodiment of the present invention.

FIG. 13 shows an arrangement in which the discharge slot 9 is provided on a projecting part 29 which projects outwardly from a back-plate 31 forming a rear part of the dryer 1100. In this case the discharge slots face the floor, not a lower part of the hand dryer; this provides the benefit of a large clearance underneath the discharge aperture for pitching the hands in use.

Figure 14:
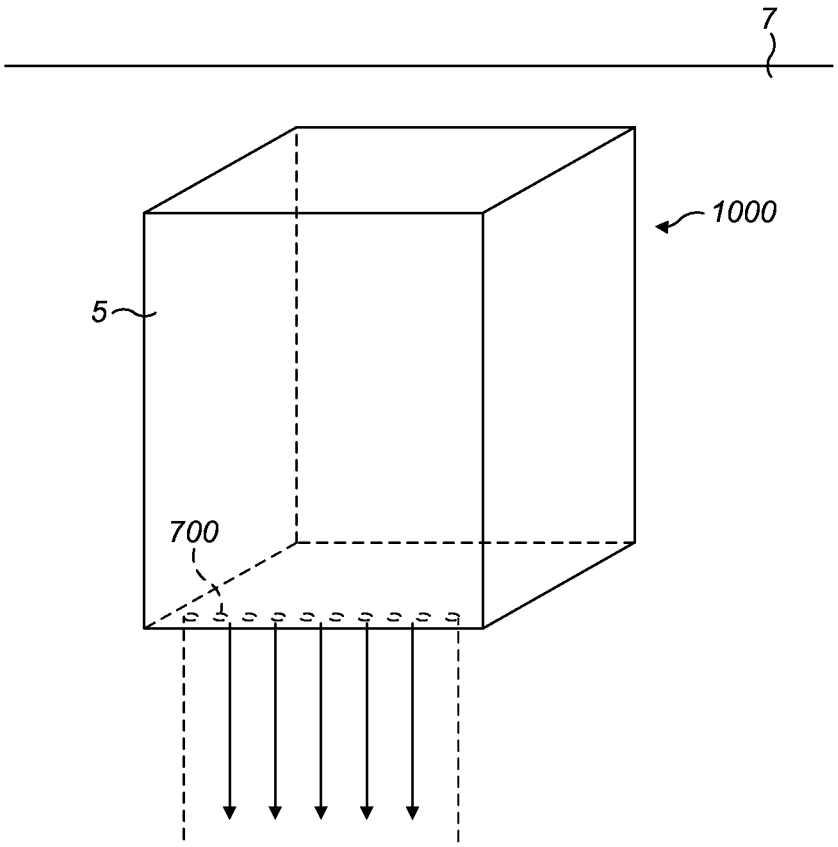
FIG. 14 is a schematic perspective view of a wall-mountable hand dryer in accordance with a seventh embodiment of the present invention.
Figure 15:
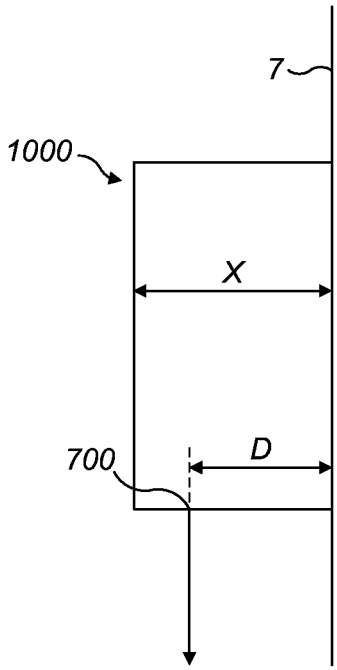
FIG. 15 is a side view corresponding to FIG. 14.

FIGS. 14 and 15 show a dryer 1000 which comprises discharge apertures in the form of a row of closely-spaced holes 700 formed in the wall of the casing 5.

Figure 2:
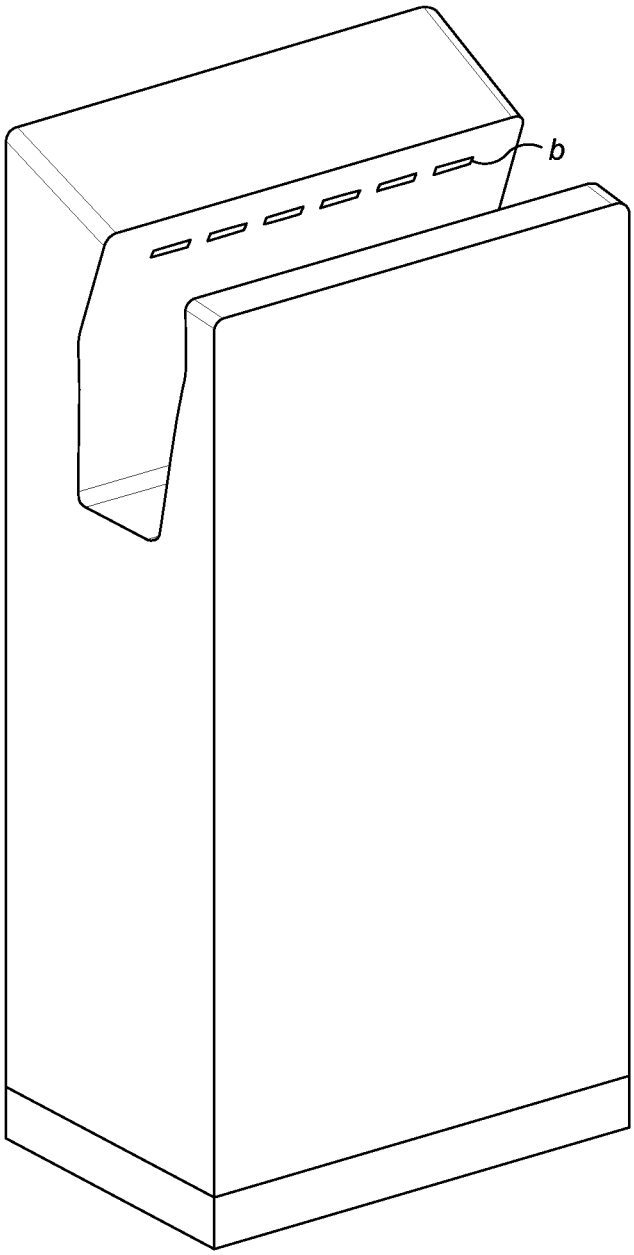
FIG. 2 Prior Art

ADA compliance is not an essential part of the invention. The depth X of the dryer may be up to 150 mm when it is surface mounted on the wall: this is still a significantly shallower profile than the conventional air-knife hand dryers illustrated in FIGS. 1 and 2.

The invention provides a relatively shallow hand dryer which nevertheless provides an effective air-knife drying action which is comfortable to use.

The invention claimed is:

1. A wall-mountable air knife hand dryer which uses an air-knife to wipe water from a user's hand, the hand dryer being configured to have a maximum depth, front-to-back, of 150 mm or less when it is surface-mounted on—rather than recessed within—a wall, the dryer having a projecting part which projects outwardly either from the wall or from a rear part of the dryer, the air-knife being directed downwardly onto the user's hand as it is passed lengthwise underneath the projecting part of the dryer, the air knife being discharged through one or more discharge apertures at a speed of at least 80 m/s, the one or more discharge apertures being positioned towards a front of the projecting part so that they are spaced at least 75 mm from the wall or the rear part of the dryer.

2. The hand dryer of claim 1, wherein said maximum depth of the hand dryer is 4 inches (101.6 mm) or less.

3. The hand dryer of claim 1 or 2, wherein the discharge apertures are spaced said maximum depth from the wall.

4. The hand dryer of claim 1, wherein the one or more discharge apertures are provided on an underside of the projecting part.

5. The hand dryer of claim 4, wherein the one or more discharge apertures are provided along a front lower edge of the projecting part.

6. The hand dryer of claim 1, wherein the projecting part is an external casing of the hand dryer.

7. The hand dryer of claim 6, the discharge apertures being arranged in a V-configuration viewed from the front of the dryer.

8. The hand dryer of claim 1, wherein the discharge apertures face a lower part of the dryer, the discharge apertures being spaced at least 120 mm from said lower part of the dryer.

9. The hand dryer of claim 1, wherein the air-knife is discharged through a single aperture in a form of an elongate slot.

10. The hand dryer of claim 1, wherein the air-knife is discharged through an elongate line of individual air holes.

11. The hand dryer of claim 9 or 10, wherein the width of the slot, or the width of each air hole, is less than 2 mm.

12. The hand dryer of claim 9 or 10, wherein the length of the slot, or the combined length of the line of air holes, is at least 80 mm.

13. The hand dryer of claim 9 or 10, wherein the dryer comprises two such slots or lines of air holes for discharging two respective, separate air knives: one air knife for each hand.

* * * * *